United States Patent [19]

Ignatjev

[11] 3,957,013

[45] May 18, 1976

[54] PORTABLE EVENT DETECTING ALARM

[76] Inventor: Vladimir Ignatjev, 39 Ledgewood Drive, Norwalk, Conn. 06850

[22] Filed: Aug. 28, 1974

[21] Appl. No.: 501,208

[52] U.S. Cl. ..... 116/81; 116/86; 116/99

[51] Int. Cl.[2] ..... G08B 13/12

[58] Field of Search ..... 116/86, 8, 12, 94, 77, 116/81, 82, 100, 75, 67 R

[56] References Cited

UNITED STATES PATENTS

| | | | |
|---|---|---|---|
| 183,562 | 10/1876 | Harper | 116/86 X |
| 608,145 | 7/1898 | Rawls | 116/94 |
| 2,600,609 | 7/1952 | Barton | 116/94 |
| 2,834,315 | 5/1958 | Simpson | 116/67 R |
| 3,185,127 | 5/1965 | Chedister | 116/86 |
| 3,372,585 | 3/1968 | Niskin | 73/170 A |
| 3,690,286 | 7/1971 | Gantt | 116/86 |

*Primary Examiner*—Richard C. Queisser
*Assistant Examiner*—Daniel M. Yasich
*Attorney, Agent, or Firm*—St. Onge Mayers Steward & Reens

[57] ABSTRACT

A portable alarm is described wherein an alarm indication is obtained from remotely accessible areas. A flexible alarm event sensor is placed in the area sought to be protected. Incremental movements of the event sensor are detected and cause motion of a hub to enable a trigger element, which normally restrains an actuator, to be pivoted aside. The movement of the trigger element enables the actuator to be released to register indication of an alarm such as activating an acoustic sound source or the closure of a switch and the like. An alternate embodiment for a trigger mechanism in accordance with the invention is described.

8 Claims, 7 Drawing Figures

Fig. 1
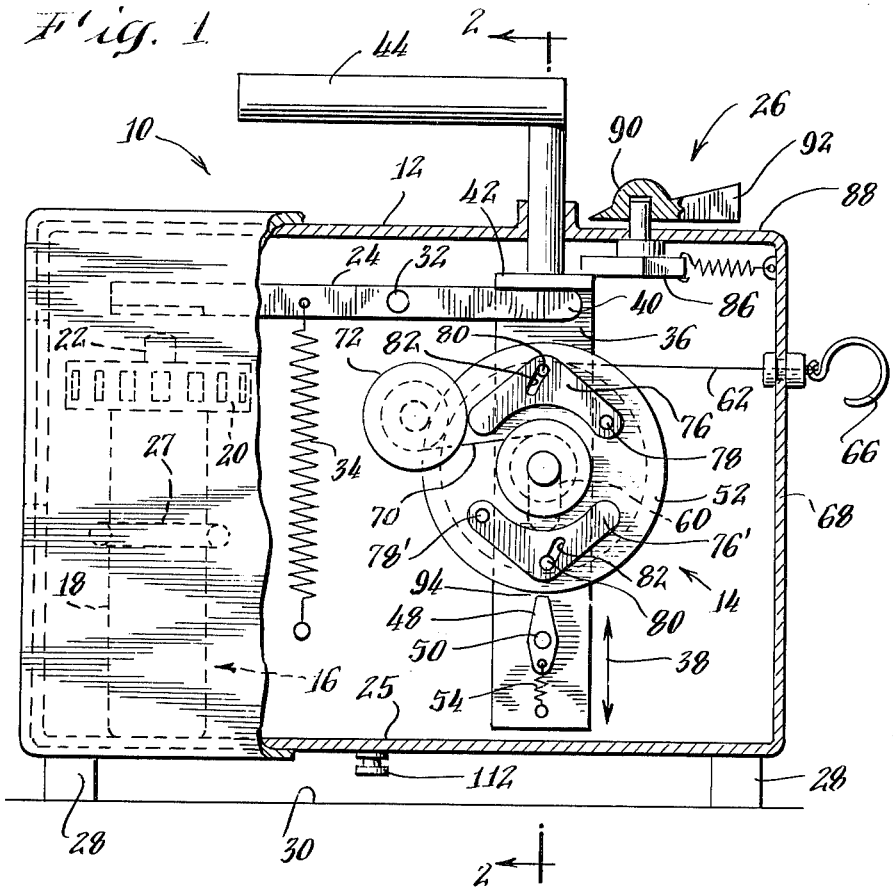
Fig. 2.
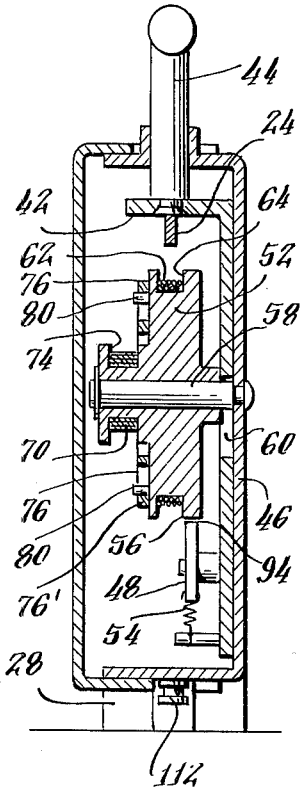
Fig. 3.
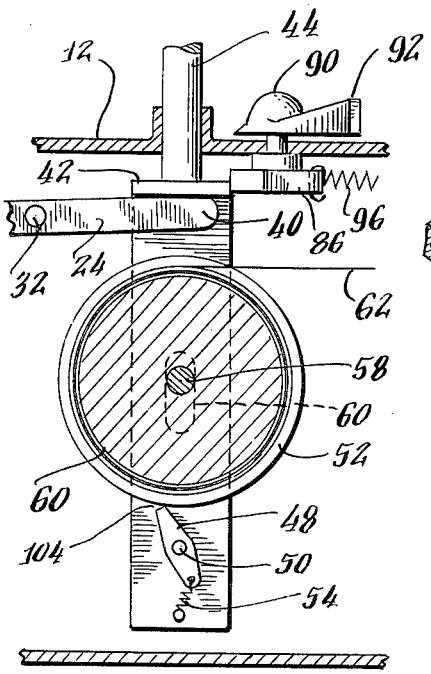
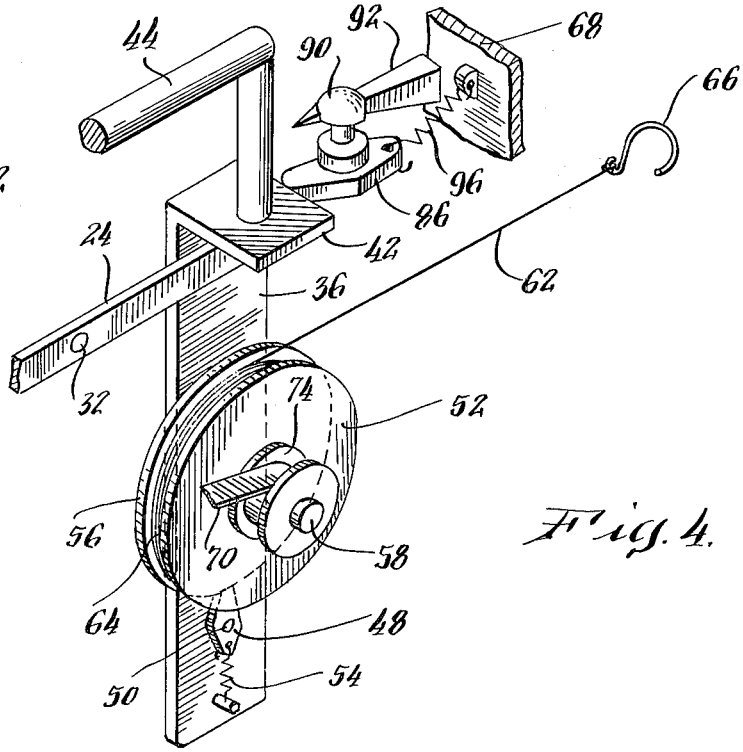
Fig. 4.

PORTABLE EVENT DETECTING ALARM

FIELD OF THE INVENTION

This invention relates to an alarm. More specifically, this invention relates to a portable device for generating an alarm indication.

BACKGROUND OF THE INVENTION

Alarms have been extensively described and shown in the art. Alarms may be electrically or mechanically actuated and employ sirens, bells or other warning devices such as the horn described in the U.S. Pat. No. 3,670,689 to Pappas.

Alarms serve a wide variety of purposes, such as registering flood conditions, illegal entries, etc. Portable alarms are particularly useful in areas where fixed alarms are difficult to install and may be conveniently applied to a multiple number of uses.

SUMMARY OF THE INVENTION

In an alarm formed in accordance with the invention, a convenient portable alarm is formed with an extendable alarm event sensor whose incremental movement causes a triggering of an alarm indicating condition. The extendable alarm event sensor is coupled to a trigger mechanism which normally restrains an actuator in a cocked position with a trigger element sensitive to motion of the alarm event sensor. When the alarm event sensor is moved, the trigger element responds with a motion sufficient to release the actuator and enable it to register an alarm indication such as be actuating a horn or closure of a switch or the like.

As described with respect to a preferred embodiment for an alarm in accordance with the invention, the trigger mechanism is formed with a rotatable hub which is normally biased to rotate in one direction with a suitable hub spring. The extendable event sensor is flexible and wound around the hub in a direction to cause rotation of the hub against the action of the hub spring to assure a taut condition of the flexible event sensor when it is operatively installed. The trigger element is located to contact a peripheral surface of the hub and pivot away whenever the hub is moved in response to an alarming motion of the flexible event sensor.

The alarm in accordance with the invention is particularly convenient for use as a portable alarm capable of being employed in versatile situations for sensing many different alarming situations. The alarm is sensitive to small movements of the alarm event sensor and is conveniently capable of responding with a large force to activate a variety of indications.

It is, therefore, an object of the invention to provide a portable alarm for use in multiple situations. It is a further object of the invention to provide an alarm sensing mechanism of high sensitivity to alarming conditions.

BRIEF DESCRIPTION OF DRAWINGS

These and other advantages and objects of an alarm in accordance with the invention can be understood from the following description of a preferred embodiment described in conjunction with the drawings wherein FIG. 1 is a partial section view of a portable alarm in accordance with the invention;

FIG. 2 is a section view of the alarm taken along the line 2—2 in FIG. 1;

FIG. 3 is a partial view of the alarm mechanism shown in an alarm indicating position;

FIG. 4 is a perspective view of segments of the alarm in accordance with the invention as shown in FIG. 1;

DETAILED DESCRIPTION OF EMBODIMENT

Figure 5:
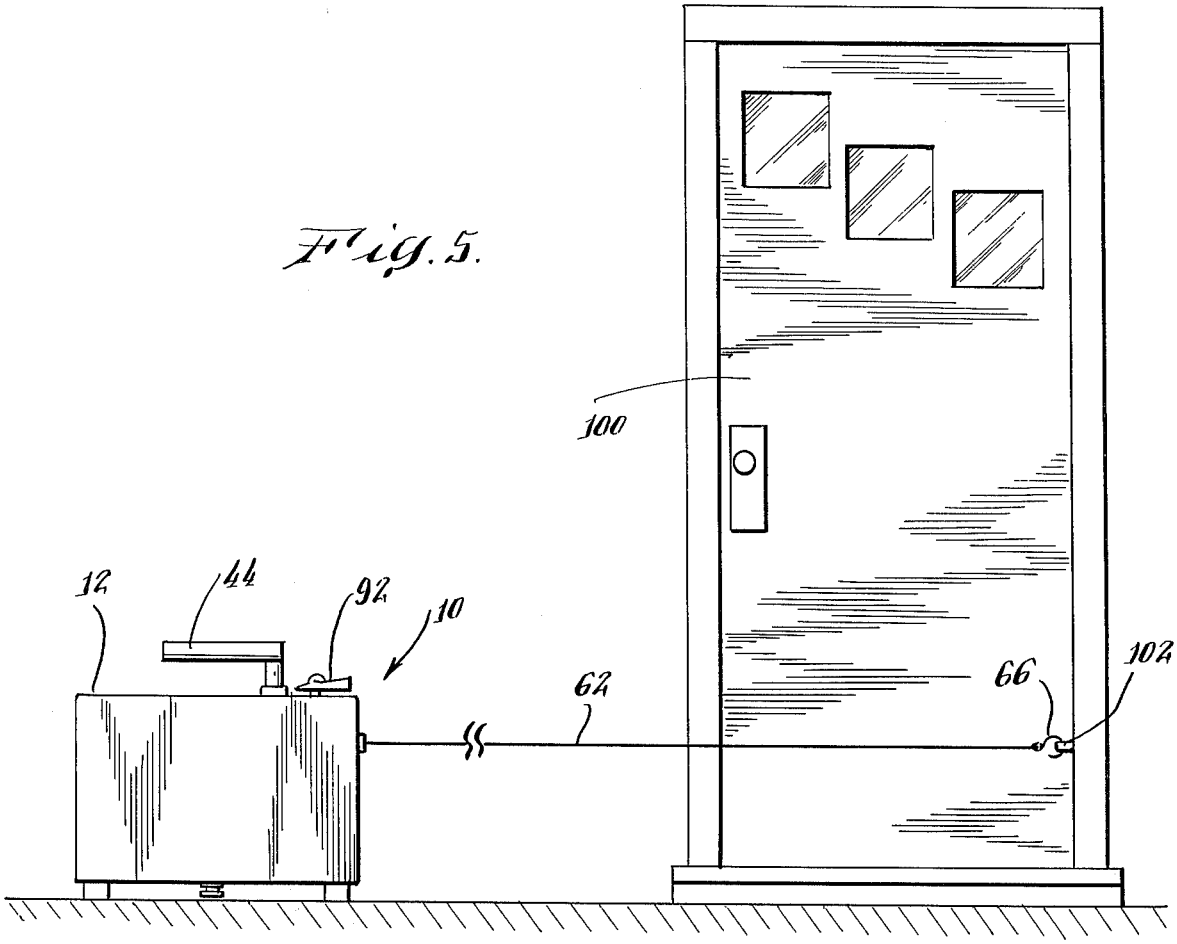
FIG. 5 is a side view in elevation of an alarm in accordance with the invention shown in position to sense the opening of a door.

With reference to FIGS. 1 through 4, an alarm 10 in accordance with the invention is shown formed with a housing 12 sized to receive an alarm mechanism 14 and an alarm producing sound source 16 in operative position relative to the alarm mechanism 14. The sound source 16 may be a pneumatic cylinder 18 containing pressurized air. The air is released through a horn or siren 20 upon the downward depression of a valve 22 by a lever 24 poised about valve 22 and controlled by alarm mechanism 14. Sound source 16 may be retained on the bottom 25 of housing 12 with a suitable bracket 27 wrapped around container 18. A safety lock 26 is employed to maintain the alarm mechanism 14 in a cocked position when the alarm is not used. Housing 12 is shown provided with suitable spacers 28 to elevate the housing above the floor 30.

The alarm mechanism 14 provides an alarm indication in the form of a pivot movement of lever 24 about a pivot 32 to actuate valve 22 under action by a spring 34 anchored between housing 12 and lever 24. Lever 24 is poised about valve 22 by an actuator 36 mounted for movement along a direction as shown by double headed arrow 38. End 40 of the lever 24 is retained below an L shaped extension 42 of actuator 36 and located on the other side of pivot 32 from that to which spring 34 is anchored. A handle 44 extends upwardly through a suitable guide hole in the upper wall of housing 12 to enable manipulation of the actuator 36.

Actuator 36 is in the shape of a bracket which extends along the wall 46 of housing 12 to support a trigger element 48 which is pivotally mounted about a pivot shaft 50 below a hub 52 of alarm sensing mechanism 14. A spring 54 is anchored between one end of trigger element 48 and actuator 36 to normally align element 48 along the operation direction of actuator 36, i.e. the direction shown by double headed arrow 38. Hence, when the alarm is armed, i.e. the safety lock 26 is opened, the pressure element inhibits actuator 36 from moving to its release position by contacting a circumferential surface 56 of hub 52.

Hub 52 is rotatably mounted to the housing 12 with a shaft 58 extending through a slot 60 in actuator 36 for attachment to wall 46. The shaft 58 and trigger element 48 are so located relative to each other that the force of the trigger element 48 on hub 52 is directed along a radial of the hub 52 to enable stable restraint of actuator 36.

Hub 52 is provided with a flexible event sensor in the form of a suitable wire or rope line 62 wound in a clockwise direction in a groove 64 of hub 52. A fastener such as a hook 66 is attached to line 62 for convenient connection to an external region which is to be monitored. Line 62 is threaded through a suitable hole in a side wall 68 of housing 12 so that hook 66 may further serve as a stop when the flexible event sensor line 62 is wound up on hub 52.

Hub 52 is biased in a direction to wind up line 62 with a constant force negator spring 70 connected to a drum 72 and a spring groove 74 on hub 52. In addition, hub 52 is provided with speed limiters in the form of centrifugal brake plates 76–76' pivotally attached to the hub 52 at 78–78' respectively. Radial movement of plates 76 is limited with pins 80 mounted to hub 52 and axially protruding into slots 82 of plates 76.

Operation of alarm 10 is controlled with a lock 26 formed by a latch plate 86 pivotaly attached to the upper wall 88 of housing 12 with a shaft 90 extending through wall 88 for attachment to and control by a knob 92 accessible from outside of housing 12. As shown in FIG. 4, latch plate 86 is shaped and located to overlap the L shaped extension 42 of actuator 36 to inhibit the latter's movement to a release position when the alarm is not in use.

Figure 6:
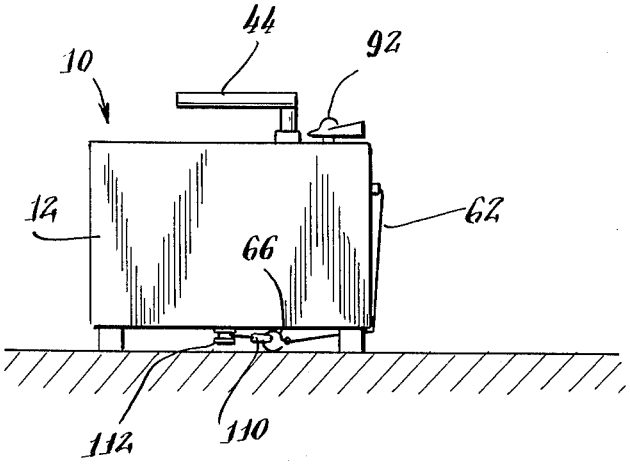
FIG. 6 is a side view in elevation in accordance with the invention shown in position on a floor to sense a flooding condition.

With the lock 26 in effect the actuator 36 is sufficiently depressed that a small gap 94 is formed between pressure element 48 and hub 52 as shown in FIGS. 1 and 2. Hence, when the latch plate 86 is in a locking position as shown in FIGS. 1 and 2, hub 52 may be rotated and the flexible event sensor 62 unwound from hub 52 for installation in an area to be protected as illustrated in FIGS. 4 through 6. A spring 96 is anchored between latch plate 86 and wall 68 of housing 12 to provide a restoring force towards a locking position.

To operate the alarm 10 the alarm mechanism 14 is locked and the alarm located in an area to be protected, for example, the door 100 in FIG. 5. The flexible event sensor 62 is uncoiled and its hook 66 attached to door hinge 102. The alarm 10 is placed along a suitable wall with the sensor 62 extending in a taut manner, by virtue of the bias action of spring 70, closely along the surface of the door 100.

With the alarm 10 in place, the knob 92 is pivoted to allow spring 34 to raise actuator 36 and bring the upper edge of pressure element 48 in contact with the peripheral surface 56 of hub 52 and thus inhibit further release movement of actuator 36. Note, as shown in FIG. 3, that the upper surface 104 of L shaped extension 42 of the actuator has moved an equivalent distance to the width of gap 94 to prevent latch plate 86 to return to a locking position. The alarm 10 is now armed and cocked for operation.

When the door 100 is opened, the open door edge is pushed against the line sensor 62 and a motion is induced on the flexible event sensor 62 causing hub 52 to rotate. When hub 52 is rotated, the trigger element 48 is pivoted off its aligned inhibiting position to thereby enable actuator 36 to move upwardly to its release position under action by spring 34. Lever 24 is driven downwardly to apply a force on valve 22 and activate siren 16.

Sensitivity of the alarm 10 to movements of flexible event sensor 62 may be controlled by selectively shaping of the contacting surface 104 of trigger element 48. Thus when surface 104 is broadened and contoured to the curvature of the surface 56, a correspondingly greater amount of rotational movement of hub 52 is needed to pivot the pressure element 48 aside to trigger the alarm mechanism 14. When the surface 104 is formed into a small rounded convex shape with a curvature opposite to that of surface 56, a high trigger sensitivity is achieved whereby small incremental movements of flexible event sensor 62 are sufficient to trigger the alarm 10.

Another application of alarm 10 involves, for example as shown in FIG. 6, the sensing of a flood condition in a basement of a home. The flexible event sensor 62 in this case is extended with its hook 66 connected to a dissolvable material 110 which, in turn, is connected to a stud 112 extending downwardly from the bottom wall 25 of housing 12. When the floor 30 is covered with water, the material 110, which could be, for example, a LIFESAVER candy, dissolves to thus release the flexible sensor 62. This, in turn, causes rotational movement of hub 52 and enables actuator 36 to move to its release alarm indicating position. A similar approach may be employed to sense fire or excessive heat conditions by using a material 110 having a known appropriate melting or softening temperature.

Although the portable alarm 10 is shown provided with a siren to generate an alarm indication, one may appreciate that other forms for indicating an alarm may be employed. For example, one may contemplate a portable radio alarm sending transmitter which is actuated by the closing of a switch when actuator 36 is released.

Figure 7:
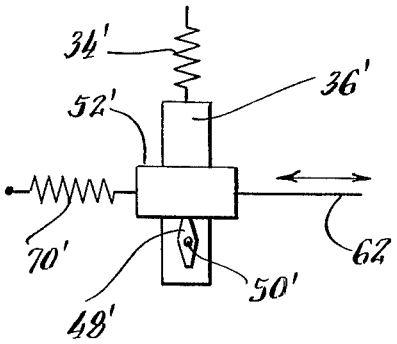
FIG. 7 is a schematic representation of an alternate embodiment for an alarm mechanism.

Having thus described an alarm in accordance with the invention, other forms can be employed. One may, for example, contemplate an actuator which is restrained with a linearly moving block or hub 52' as shown in FIG. 7. Whenever flexible event sensor 62' is moved in the direction as shown by double headed arrow 114, the trigger element 48' is pivoted aside to enable release of actuator 36'.

The various advantages of a portable alarm in accordance with the invention may thus be appreciated.

What is claimed is:

1. A mechanism for producing an indication for an alarm in response to a detectable event comprising a housing;

an actuator mounted to the housing for movement along a predetermined path from a cocked position to an alarm producing position;

a biased event detector including a flexible element and having a cocked position and having a trigger contacting surface to inhibit motion of said actuator, said event detector mounted to the housing to move along the predetermined path to generate an event sensing motion of the trigger contacting surface in a direction selected to enable release motion of the actuator along the predetermined path when the event detector, in its cocked position, is moved in response to a detected event; and a trigger element pivotally mounted to the actuator and having a contacting edge which is located thereon for edge contact with the trigger contacting surface of the event detector at an area thereof selected to lie along a line which is generally parallel with the predetermined path to inhibit release movement of the actuator along the predetermined path, said trigger element being mounted for pivot movement to a release position in response to motion of the event detector to enable the actuator to move to an alarm producing position in response to an event sensing motion of the event detector.

2. The alarm indication producing mechanism as claimed in claim 1 wherein the contacting edge of the trigger element has a shape selected in accordance with a desired alarm sensitivity of the mechanism.

3. The alarm indication producing mechanism as claimed in claim 2 wherein the event detector includes a hub mounted for event sensing rotation about an axis to the housing, with the hub axis being located along the predetermined path and with the trigger element aligned to operatively contact a radially exposed surface of the hub along a radial generally parallel with the predetermined path whereby the trigger element moves away from the radially exposed surface to a release position upon event sensing rotation of the hub and enable the actuator to move along the predetermined path for an alarm indication.

4. The alarm indication producing mechanism as claimed in claim 3 wherein the event detector further includes means for rotationally biasing the hub in a first direction; and a flexible member wound up around the hub in a direction to rotate the hub against the biasing means upon unwinding of the flexible member from the hub to maintain the flexible member taut.

5. An alarm indicating device comprising a housing;

a hub mounted for rotation about an axis to the housing;

an actuator mounted for movement along a radial of the hub from a cocked position to a released alarm producing position;

a trigger element mounted to the actuator for operative contact with a circumferential surface of the hub to inhibit motion of the actuator to its released alarm producing position, the trigger element being mounted for pivot movement away from the circumferential hub surface in response to hub rotation to enable release of the actuator;

means for urging the actuator towards its released alarm indicating position and apply the trigger element against the hub circumferential surface for operative contact with the hub;

a flexible event sensor wrapped around the hub for rotation thereof in a first direction upon unwinding from the hub for attachment to sense an event; and means for urging the hub in rotation in an opposite direction to that produced by unwinding of the flexible event sensor when the actuator is released when the event occurs to maintain the latter in a taut condition.

6. The alarm indicating device as claimed in claim 5 wherein the hub urging means is formed of a negator spring anchored to the housing and to the hub to provide a generally constant rotational force on the hub.

7. The alarm indicating device as claimed in claim 5 wherein the actuator is in the form of a bracket extending along a radial of the hub for operative movement along the radial, with the trigger element aligned to contact the hub peripheral surface in alignment with said radial.

8. The alarm indicating device as claimed in claim 7 wherein a locking means on the device and includes a manually controlled lever pivotly mounted to the housing and shaped to project in the radial path of the actuator upon locking pivot movement of the manual lever.

* * * * *

UNITED STATES PATENT OFFICE

CERTIFICATE OF CORRECTION

PATENT NO. : 3,957,013

DATED : May 18, 1976

INVENTOR(S) : Vladimir Ignatjev

It is certified that error appears in the above-identified patent and that said Letters Patent are hereby corrected as shown below:

Col. 2, line 25, "about" should be --above--.

Col. 2, line 37, "about" should be --above--.

Signed and Sealed this

Twentieth Day of July 1976

[SEAL]

*Attest:*

RUTH C. MASON
*Attesting Officer*

C. MARSHALL DANN
*Commissioner of Patents and Trademarks*